US012691915B2

(12) United States Patent
Piparsaniya

(10) Patent No.: US 12,691,915 B2
(45) Date of Patent: Jul. 28, 2026

(54) SYSTEM AND METHOD FOR SIGNALLING EVENTS THROUGH A VISIBILITY MARKER ASSOCIATED WITH A TRAIN

(71) Applicant: Siemens Mobility, Inc., New York, NY (US)

(72) Inventor: Harsh Piparsaniya, Pune (IN)

(73) Assignee: SIEMENS MOBILITY, INC., New York, NY (US)

( * ) Notice: Subject to any disclaimer, the term of this patent is extended or adjusted under 35 U.S.C. 154(b) by 983 days.

(21) Appl. No.: 17/677,443

(22) Filed: Feb. 22, 2022

(65) Prior Publication Data

US 2022/0266878 A1 Aug. 25, 2022

(30) Foreign Application Priority Data

Feb. 25, 2021 (IN) ..... 202141007998

(51) Int. Cl.

| | |
|---|---|
| ***B61L 15/00*** | (2006.01) |
| ***B61L 15/02*** | (2006.01) |
| ***B61L 23/04*** | (2006.01) |
| ***B61L 23/34*** | (2006.01) |

(52) U.S. Cl.

CPC ..... *B61L 15/0054* (2013.01); *B61L 15/0027* (2013.01); *B61L 15/02* (2013.01); *B61L 23/042* (2013.01); *B61L 23/34* (2013.01); *B61L 2201/00* (2013.01); *B61L 2205/00* (2013.01); *B61L 2207/02* (2013.01)

(58) Field of Classification Search

CPC .. B61L 15/00; B61L 15/0054; B61L 15/0027; B61L 15/02; B61L 23/042; B61L 23/34; B61L 2201/00; B61L 2205/00; B61L 2207/02

See application file for complete search history.

(56) References Cited

U.S. PATENT DOCUMENTS

| | | | | |
|---|---|---|---|---|
| 10,994,651 | B2 * | 5/2021 | Oswald | B60Q 1/54 |
| 11,958,512 | B2 * | 4/2024 | Haas | B61L 15/0054 |
| 11,999,391 | B2 * | 6/2024 | Piparsaniya | B61L 25/025 |
| 12,077,199 | B2 * | 9/2024 | Piparsaniya | B61L 25/025 |
| 2020/0122634 | A1 | 4/2020 | Oswald et al. | |
| 2020/0122757 | A1 * | 4/2020 | Abrosimov | B61L 15/0018 |
| 2020/0207385 | A1 | 7/2020 | Kernwein | |
| 2022/0097744 | A1 * | 3/2022 | Piparsaniya | B61L 15/0081 |
| 2022/0185350 | A1 * | 6/2022 | Kindt | B61L 1/18 |

(Continued)

FOREIGN PATENT DOCUMENTS

| | | | | |
|---|---|---|---|---|
| BR | 112019015229 | B1 * | 6/2023 | B60T 13/665 |
| EA | 021143 | B1 * | 4/2015 | |

*Primary Examiner* — Jason C Smith

(74) *Attorney, Agent, or Firm* — Schmeiser Olsen PLLC

(57) ABSTRACT

An End-of-Train device, a system and a method for signaling events through a visibility marker is provided. The method includes identifying an illumination pattern generated by the visibility marker associated with an End-of-Train device on a leading train, wherein the illumination pattern is identified based on output of one or more secondary sensors on the follower train, and wherein the illumination pattern is indicative of an event affecting an operation of the leading train. Based on the identified illumination pattern one or more instructions to be executed are determined. Further, the one or more instructions are executed for signalling events through the visibility marker associated with the follower train.

15 Claims, 6 Drawing Sheets

(56) References Cited

U.S. PATENT DOCUMENTS

| | | | | |
|---|---|---|---|---|
| 2022/0266878 | A1* | 8/2022 | Piparsaniya | B61L 15/02 |
| 2022/0281496 | A1* | 9/2022 | Fernandes | B61L 15/0054 |
| 2023/0063525 | A1* | 3/2023 | Fernandes | B61L 15/0027 |
| 2023/0065249 | A1* | 3/2023 | Fernandes | H04W 4/029 |
| 2023/0066917 | A1* | 3/2023 | Piparsaniya | B61L 15/0027 |
| 2023/0202538 | A1* | 6/2023 | Fernandes | B61L 15/0027 246/167 R |
| 2024/0067242 | A1* | 2/2024 | Piparsaniya | B61L 25/025 |
| 2024/0223895 | A1* | 7/2024 | Haas | H04N 7/18 |

* cited by examiner

SYSTEM AND METHOD FOR SIGNALLING EVENTS THROUGH A VISIBILITY MARKER ASSOCIATED WITH A TRAIN

CROSS-REFERENCE TO RELATED APPLICATIONS

This application claims priority to IN Application No. 202141007998, having a filing date of Feb. 25, 2021, the entire contents of which are hereby incorporated by reference.

FIELD OF TECHNOLOGY

The following relates to a field of rail automation, and more particularly relates to a system and method for signalling events through a visibility marker associated with a train.

BACKGROUND

At present, communication between trains occur with the help of wayside equipment. The locomotive driver of a train has to keep an eye on trains ahead of them in order to take immediate actions in response to emergency situations. For example, in case emergency brakes on the leading train are applied, the locomotive driver on a follower train should also initiate application of brakes to prevent collision. Similarly, in emergencies such as derailment or unauthorized reverse movement by the leading train, the locomotive driver on the follower train has to take immediate action to stop or slow down the follower train. However, if the locomotive driver fails to notice an emergency, it may result in catastrophe. Therefore, there is a need for a system and method for signalling events associated with a leading train to a follower train and for managing operation of the follower train based on the events associated with the leading train.

SUMMARY

Aspects of embodiments of the present invention relate to signalling events through a visibility marker associated with a train. In one embodiment, an End-of-Train device for mounting on a train is disclosed. The End-of-Train device comprises at least one sensor for detecting an event affecting an operation of the train. The End-of-Train device further comprises a visibility marker comprising one or more Light Emitting Diodes (LEDs), wherein the one or more LEDs is selectively activated to generate an illumination pattern based on the event. The End-of-Train device further comprises a control circuitry configured for generating trigger signals for the one or more LEDs based on the event detected by the at least one sensor, wherein the trigger signals selectively activate the one or more LEDs to generate the illumination pattern. Further, a train comprising an End-of-Train device as described above is also disclosed.

In another embodiment, a system for managing operation of a follower train based on events signalled by a visibility marker on a leading train is disclosed. The system comprises an End-of-Train device comprising the visibility marker as described above, mounted on the leading train. The system further comprises a secondary sensor installed on the follower train. The secondary sensor is configured to detect an illumination pattern generated by a visibility marker on the leading train. The system further comprises a sensing subsystem on the follower train configured to execute one or more instructions based on the illumination pattern detected by the secondary sensor.

In yet another embodiment, a method for managing operation of a follower train based on events signalled by a visibility marker on a leading train is disclosed. The method comprises identifying, by a sensing subsystem on the follower train, an illumination pattern generated by the visibility marker associated with an End-of-Train device on the leading train. The illumination pattern is identified based on output of one or more secondary sensors on the train. The illumination pattern is indicative of an event affecting an operation of the leading train. The method further comprises determining one or more instructions to be executed based on the identified illumination pattern. The method further comprises executing one or more instructions based on the identified illumination pattern for managing an operation of the train.

BRIEF DESCRIPTION

Some of the embodiments will be described in detail, with reference to the following figures, wherein like designations denote like members, wherein.

Figure 4:
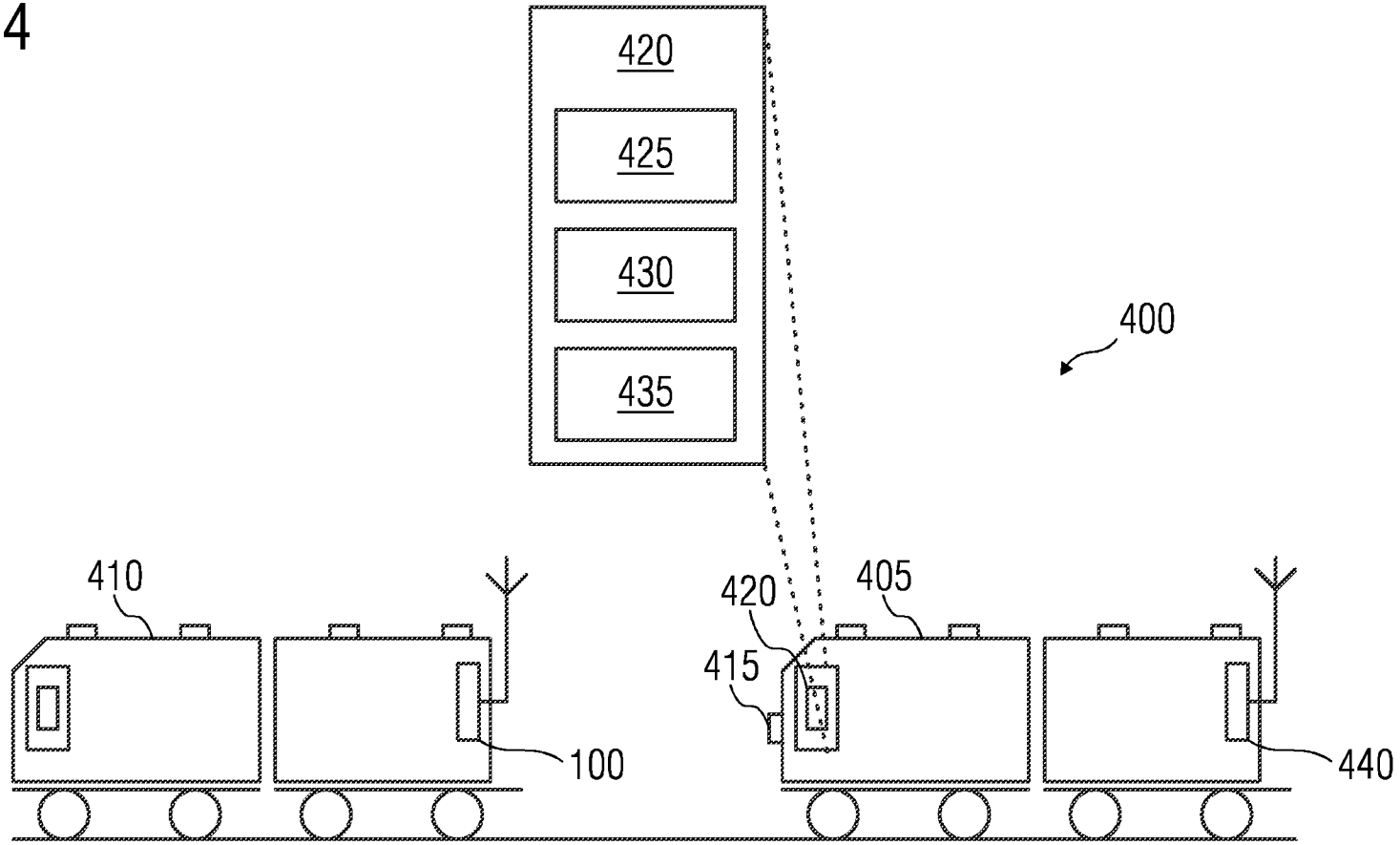
Figure 5:
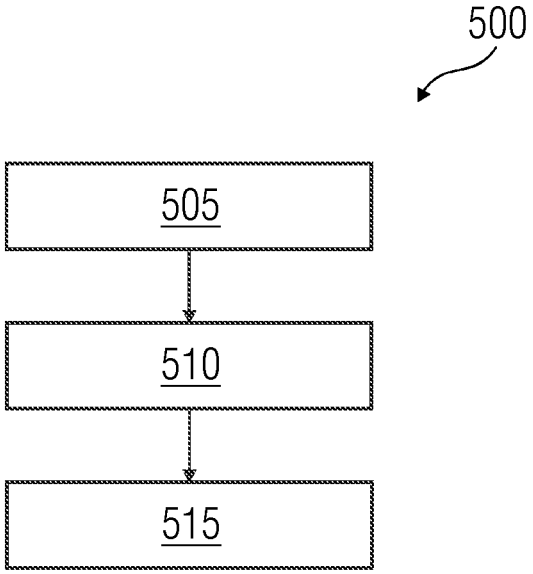

FIG. 4 illustrates a system for managing operation of a follower train based on events signaled by a visibility marker on a leading train, in accordance with an exemplary embodiment of the present invention; and FIG. 5 shows an exemplary method of managing operation of the follower train based on events signaled by the visibility marker on the leading train, in accordance with an embodiment of the present invention.

DETAILED DESCRIPTION

Various embodiments of the present invention are described with reference to the drawings, where like reference numerals are used in reference to the drawings. Like reference numerals are used to refer to like elements throughout. In the following description, numerous specific details are set forth in order to provide a thorough understanding of embodiments. These specific details need not be employed to practice embodiments. In other instances, well known materials or methods have not been described in detail in order to avoid unnecessarily obscuring embodiments. While the disclosure is susceptible to various modifications and alternative forms, specific embodiments thereof are shown by way of example in the drawings and will herein be described in detail. There is no intent to limit the disclosure to the particular forms disclosed. Instead, the disclosure is to cover all modifications, equivalents, and alternatives falling within the scope of embodiments of the present invention.

Figure 1A:
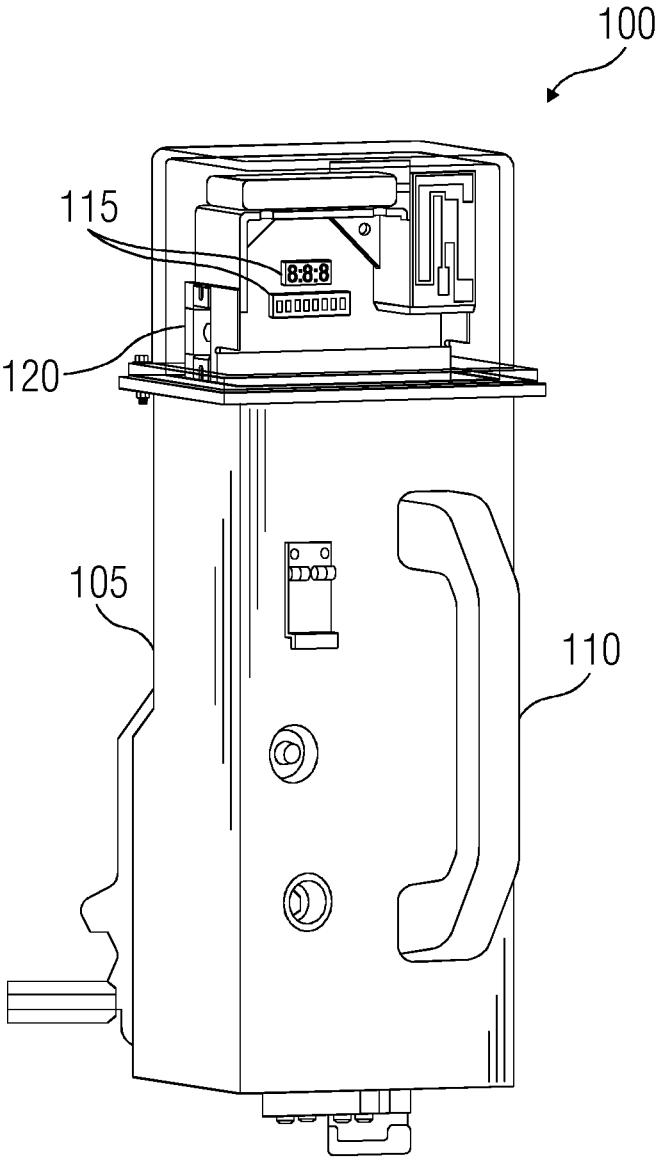
FIG. 1A shows a schematic view of an End-of-Train device, in accordance with an exemplary embodiment of the present invention.

FIG. 1A shows a schematic view of an End-of-Train (EOT) device 100, in accordance with an exemplary embodiment of the present invention. The EOT device 100 comprises an enclosure 105. The enclosure 105 may be made of, for example, plastic, metal or alloy. The term 'train' as used herein may refer to a rail vehicle used in mass transit, mainline transit or freight transportation over a railway track. The EOT device 100 further comprises a handle 110 attached to the enclosure 105 for handling, such as installation and removal of the EOT device 100 on/off a train car of the train, in particular a last train car. The EOT device 100 further includes one or more displays 115. The one or more displays 115 display information and/or data provided by the EOT device 100. The EOT device 100 further includes a visibility marker 120 adapted to indicate an event associated with the train. The event includes at least one of a fault or a condition associated with the train or an environment of the train, that affects an operation of the train. The visibility marker 120 includes one or more us configured to illuminate a rear end of the railway vehicle. In an embodiment, the visibility marker 120 comprises an array of LEDs. In an alternate embodiment, the visibility marker 120 may include a single LED.

The EOT device 100 is coupled to the rear-end of the train using a coupling unit (not shown) attached to the enclosure 105. In addition to the above, the EOT device 100 may also include other components such as cell phone transceivers, systems for monitoring/controlling brake lines, communication systems for communicating with other units such as Head-of-Train (HOT) devices and the like. A person having ordinary skill in the art is familiar with structure, components and functions of different types of EOT devices, and therefore, these aspects will not be described in further detail herein.

Figure 1B:
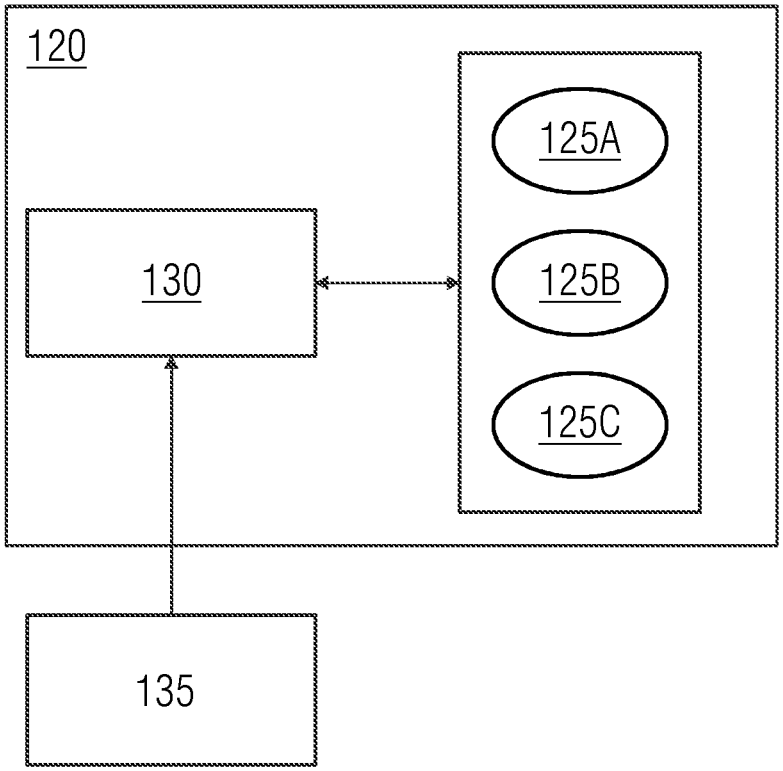
FIG. 1B illustrates functional block diagram of a visibility marker in the End-of-Train device, in accordance with an exemplary embodiment of the present invention.

FIG. 1B illustrates functional block diagram of the visibility marker 120 in the EOT device 100, in accordance with an exemplary embodiment of the present invention. The visibility marker 120 includes an array of Light Emitting Diodes (LEDs) 125A, 125B and 125C communicatively coupled to a control circuitry 130. For example, the array of LEDs 125A, 125B and 125C may indicate red, green and yellow colors respectively. In an alternate embodiment, the visibility marker 120 may include a single LED. In an embodiment, the control circuitry 130 is a digital logic circuit that detects the event based on digital inputs received from at least one sensor 135. The at least one sensor 135 is at least one of an accelerometer, a proximity sensor, a camera, a daylight sensor and a pressure sensor. In another embodiment, the control circuitry 130 may be an analog circuit that determines the event based on analog inputs received from the at least one sensor 135. In yet another embodiment, the control circuit detects the event based on a predefined logic, using inputs from the at least one sensor 135 and radio-frequency messages from a Head-of-Train device associated with the train. The EOT device 100 further comprises a transceiver unit (not shown) configured to enable communication between the End-of-Train device and the Head-of-Train device associated with the train.

In the present embodiment, one or more LEDs in the array of LEDs 125 are selectively illuminated based on an illumination pattern determined based on occurrence of the event. It must be understood by a person skilled in the art that it is also possible to group a plurality of LEDs from the array of LEDs to form a single LED light. In an example, the event includes application of brakes on the train. It must be understood that the brakes may include both air brakes as well as emergency brakes. In an embodiment, the application of brakes may be determined based on, for example, pressure transducers (not shown) installed on brake pipes of the train. In another embodiment, when the driver of the train initiates emergency braking, a Head-of-Train device on the train transmits a message to the EOT device 100 over Radio-Frequency communication. Upon receiving the message, the EOT device 100 indicates the event of braking through a suitable illumination pattern.

In another example, the event is associated with distance between the train and a follower train reducing below a predefined safe distance. The presence of a follower train within the safe distance may be detected, for example, using an ultrasonic proximity sensor (not shown) on the train. In yet another example, the event is associated with reverse movement of the train. The reverse movement of the train may be detected using, for example, a camera and an accelerometer. In yet another example, the event is associated with derailment of the train. The derailment of the train may be detected using one or more 3D accelerometers (not shown) installed on the train. In yet another example, the event is associated with detection of faults in a railway track whereon the train runs. The faults in the railway track may be detected using, for example, an imaging device (not shown) installed in an undercarriage of the train. In addition, the at least one sensor 135 may also include a daylight sensor configured to detect intensity of sunlight. The daylight sensor may be a photoelectric sensor that generates an output signal corresponding to the intensity of sunlight. In an embodiment, the output signal from the daylight sensor is used to adjust a luminous intensity of light emitted by the visibility marker 120, based on intensity of sunlight. For example, during morning hours the daylight sensor detects intense sunlight compared to evenings. The output signal from the daylight sensor is provided as an additional signal in order to control the luminous intensity of the LED lights 125. The operation of the visibility marker 120 is further explained in detail below with reference to FIG. 2.

Figure 2:
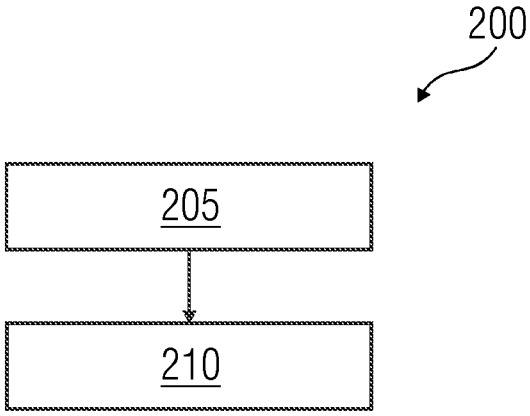
FIG. 2 shows an exemplary method of controlling operation of the visibility marker, in accordance with an embodiment of the present invention.

FIG. 2 shows an exemplary method 200 of controlling operation of the visibility marker 120, in accordance with an embodiment of the present invention. At step 205, an event affecting an operation of a train is detected based on output from at least one sensor 135 on the train, on which the EOT device 100 is mounted. The event is associated with a fault or an operating condition affecting an operation of the train. The event is detected based on individual outputs from the at least one sensor 135, or based on a combination of the outputs from one or more sensors on the train. In an embodiment, the outputs from the at least one sensor may be processed using an analog circuit or a digital circuit to generate an output indicative of the event.

At step 210, a trigger signal is generated based on the event for selectively activating one or more LEDs in the visibility marker 120 to generate an illumination pattern indicative of the event. The illumination pattern may be configured to indicate the event by for example, color, duration of activation, frequency of activation or sequence of activation of the one or more LEDs. Further, the luminous intensity of the activated LEDs is controlled based on output from a daylight sensor on the train.

In an example, if the distance between the leading train and the train is less than a predefined safe distance, the illumination pattern may include periodically activating red colored LEDs in the visibility marker 120 for a duration of 1 second at intervals of 0.5 seconds. Further, the frequency of activation of the red LEDs may increase as the distance between the leading train and the train reduces. In another example, the illumination pattern may include activation of yellow LEDs when a distance between the leading train and the follower train is below a first safe distance. When the distance between the leading train and the follower train further reduces below a second safe distance, high intensity red LEDs are activated.

In another example, if one or more image sensors on the leading train determine presence of faults on the railway track, the illumination pattern for indicating the fault to the follower train includes alternating between red and yellow lights over predefined intervals of time. For example, red LEDs may be activated for 1 second, followed by yellow LEDs for 2 seconds, again followed by red LEDs for 1 second and so on.

Figure 3:
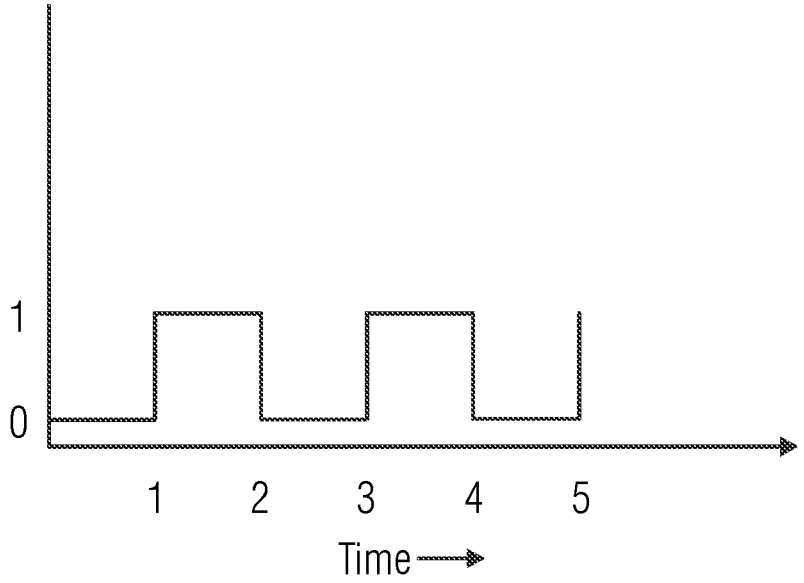
FIG. 3 shows an example of a trigger signal generated by a digital logic circuit, in accordance with an embodiment of the present invention.

In yet another example, when the driver of the train initiates emergency braking, a Head-of-Train device on the train transmits a message to the EOT device 100 over Radio-Frequency communication. Upon receiving the message, the control circuitry 130 generates trigger signals for activating high intensity red LEDs in the visibility marker 120. In yet another example, if the at least one sensor 135 detects reverse movement of the train, the illumination pattern comprises activating the yellow LEDs in the visibility marker 120 for 1 second followed by green LEDs for 1 second and so on. In yet another example, if the at least one sensor 135 detects derailment of the train, the illumination pattern may comprise blinking the red LEDs. Further, the absence of events may also be indicated using a default illumination pattern. For example, green LEDs in the visibility marker 120 may be kept ON in case no events are detected. In another instance, the HVM may be kept OFF in case no events are detected. FIG. 3 shows an example of a trigger signal 300 generated by a digital logic circuit, in accordance with an embodiment of the present invention. The trigger signal when provided to the LED causes the LED to be ON for 1 seconds and OFF for 1 seconds for a predefined period of time.

In an alternate embodiment where the visibility marker includes a single LED, the trigger signal is generated to control a timing of the LED. For example, in case of emergency braking by the leading train, the LED may be triggered to blink at intervals of 0.5 seconds.

In case the visibility marker 120 fails, the control circuitry 130 triggers a radio-requency transceiver associated with the train to generate a radio signal indicating failure of the visibility marker 120. The control circuitry 130 may diagnose failure of the visibility marker 120, for example, by performing continuity checks on each of the LEDs by performing diode test on each of the LEDs in both forward bias and reverse bias direction. When the radio signal is received by a Head-of-Train device on a follower train, a driver of the follower train is alerted to remain vigilant. For example, the Head-of-Train device may display a notification indicating that the visibility marker 120 on the leading train is non-functional.

FIG. 4, in conjunction with FIGS. 1A and 1B, illustrate a system 400 for managing operation of a follower train 405 based on events signalled by a visibility marker 120 on a leading train 410, in accordance with an exemplary embodiment of the present invention, in accordance with an exemplary embodiment of the present invention. More specifically, operation of the follower train 405 is managed based on events associated with the leading train 410 running on the same railway track. The system 400 includes the EOT device 100 on the leading train 410, and one or more secondary sensors 415 and a sensing subsystem 420 on the follower train 405.

The EOT device 100 on the leading train 410 is communicatively coupled to one or more sensors (not shown) on the leading train 410. The EOT device 100 is configured such that the visibility marker 120 generates an illumination pattern based on the output from the one or more sensors. In an embodiment, the enclosure of the EOT device 100 houses the control circuitry 130 that controls operation of one or more LEDs in the visibility marker 120 based on outputs from the one or more sensors.

The one or more secondary sensors 415 and the sensing subsystem 420 are communicatively coupled to each other. The one or more the secondary sensors 415 are configured to detect an illumination pattern generated by the visibility marker 120 on the leading train 410. In an embodiment, the secondary sensor 415 comprises at least one colorcolor sensor. The colorcolor sensor is, for example, a photoelectric sensor that detects color of an object based on wavelength of light reflected by the object. In embodiments of the present invention, the colorcolor sensor is attached to the front end of a train in order to detect color of light emitted by the visibility marker 120 associated with the EOT device 100 of the leading train. In another embodiment, the one or more secondary sensors 415 comprises a camera configured to detect and capture image of the visibility marker 120. More specifically, the image comprises illumination pattern indicated by the visibility marker 120 on the leading train. The output of the one or more secondary sensors 415 is further processed by the sensing subsystem 420. The sensing subsystem 420 is configured to execute one or more instructions based on the illumination pattern detected by the one or more secondary sensors 415.

The sensing subsystem 420 includes a processing unit 425, a memory 430 and a communication unit 435. The processing unit 425 may include any type of computational circuit, such as, but not limited to, a microprocessor, microcontroller, application specific integrated circuits, single-chip computers, and the like. The memory 430 may include one or more of a volatile memory and a non-volatile memory. The memory 430 may be coupled for communication with the processing unit 425. The processing unit 425 may execute instructions and/or code stored in the first memory 430. The memory 430 may include any suitable elements for storing data and machine-readable instructions, such as read only memory, random access memory, erasable programmable read only memory, electrically erasable programmable read only memory, hard drive, removable media drive for handling compact disks, digital video disks, diskettes, magnetic tape cartridges, memory cards, and the like. The memory 430 comprises machine-readable instructions which when executed by the processing unit 425 causes the processing unit 425 to process an output of the one or more secondary sensors 415 to determine an event represented by the illumination pattern. In an embodiment, the sensing subsystem 420 is associated with a Head-of-Train device associated with the follower train 405. In another embodiment, the sensing subsystem 420 is associated with a driver-machine interface. Further, the sensing subsystem 420 executes one or more instructions based on the event as explained below with reference to FIG. 5.

FIG. 5 shows an exemplary method 500 of managing operation of the follower train 405 based on events signalled by the visibility marker 120 on the leading train 410, in accordance with an embodiment of the present invention. At step 505, the sensing subsystem 420 identifies an illumination pattern generated by the visibility marker 120 associated with the End-of-Train device 100 on the leading train 410. The illumination pattern is identified based on output of the one or more secondary sensors 415 on the follower train 405. In an embodiment, the one or more secondary sensors 415 include color sensors that determine a color of the LEDs illuminated in the visibility marker 120 of the leading train. In an embodiment, the output of the color sensor may be an analog signal. The analog signal is processed by the subsystem to determine the color of the visibility marker 120. For example, a characteristic such as amplitude, frequency or pulse width associated with the analog signal may be analyzed to determine the color. In another embodiment, the one or more secondary sensors 415 include a camera. The camera captures images of the visibility marker 120 on the leading train 410 at predefined time intervals. For example, the image may be captured at every 10000 microseconds. Further, the captured images are analysed by an image processing algorithm in order to determine characteristics such as frequency of activation, duration of activation or sequence of activation associated with the one or more LEDs in the visibility marker 120 of the leading train 410. Based on the characteristics determined, the event associated with the leading train 410 is determined.

At step 510, one or more instructions are identified based on the illumination pattern. The one or more instructions are identified based on mappings stored in a database of the sensing subsystem 420. In an implementation, the database may include different values of outputs from the one or more secondary sensors 415 mapped to different sets of instructions using a look up table. In another implementation, the database may include different ranges of outputs from the one or more secondary sensors 415 mapped to different sets of instructions using a look up table.

At step 515, the one or more instructions are executed for managing an operation of the follower train 405, by the sensing subsystem 420. In an embodiment, the one or more instructions are associated with automatically performing an action on the follower train 405. In another embodiment, the one or more instructions are associated with providing alerts to a driver of the follower train 405. For example, the illumination pattern may indicate that the distance between the leading train 410 and the follower train 405 is less than the predefined safe distance. Consequently, the one or more instructions are associated with generating a notification on a driver-machine interface to caution a driver of the follower train 405. The notification may be in the form of audio or visual alerts. In an embodiment, the Driver-Machine Interface executes the one or more instructions to display a warning message to the driver of the follower train 405. The warning message may be of the form "WARNING: Breach of safe distance!". Upon seeing the warning message, the driver may decide to apply brakes in order to slow down the follower train 405. In an alternate embodiment, the one or more instructions may be associated with triggering a Head-of-Train (HOT) device on the follower train 405 to initiate application of brakes. More specifically, the HOT device instructs a second EOT device 440 on the follower train 405 to control a brake pressure associated with the follower train 405. It must be understood by a person skilled in the art that the brake pressure for application of brakes may be computed based on a distance between the leading train 410 and the follower train 405 as determined by one or more proximity sensors on the follower train 405.

If the illumination pattern indicates application of emergency brakes on the leading train 410, the one or more instructions may be executed by the driver-machine interface for providing an alert to the driver of the follower train 405. Further, the driver may decide whether to slow down or stop the follower train 405. In an alternate embodiment, the one or more instructions may be executed by the HOT device to automatically slow down or stop the follower train 405, based on a distance from the leading train 410.

If the illumination pattern indicates faults on the railway track, the one or more instructions may be executed by the driver-machine interface for providing an alert to the driver of the follower train 405. Subsequently, the driver may slow down the follower train 405 in order to reduce any impact due to the faulty railway track. In an alternate embodiment, the one or more instructions may be executed by the HOT device to automatically slow down the follower train 405.

If the illumination pattern indicates reverse movement of the leading train 410, the one or more instructions may be executed by the HOT device for initiating reverse movement of the follower train 405. Similarly, if the illumination pattern indicates derailment of the leading train 410, the one or more instructions may be executed by the HOT device for initiating application of brakes on the follower train 405.

Advantageously, embodiments of the present invention enable a leading train to notify critical events to a follower train, without the need for wireless communication or wayside units. As a result, embodiments of the present invention improve safety of trains either when employed alone or in combination with known techniques. Embodiments of the present invention also enable performing one or more instructions on a follower train automatically, based on the illumination pattern from the leading train.

Although the present invention has been disclosed in the form of preferred embodiments and variations thereon, it will be understood that numerous additional modifications and variations could be made thereto without departing from the scope of the invention.

For the sake of clarity, it is to be understood that the use of "a" or "an" throughout this application does not exclude a plurality, and "comprising" does not exclude other steps or elements.

The invention claimed is:

1. An End-of-Train device for mounting on a train, the End-of-Train device comprising:

at least one sensor for detecting an event affecting an operation of the train;

a visibility marker comprising one or more LEDs, wherein the one or more LEDs is selectively activated to generate an illumination pattern based on the event, wherein the illumination pattern is indicative of an instruction for controlling operation of a follower train; and a control circuitry housed by the End-of-Train device and configured for generating trigger signals for the one or more LEDs based on the event detected by the control circuitry based on digital inputs received by the at least one sensor coupled to the control circuitry, wherein the trigger signals selectively activate the one or more LEDs to generate the illumination pattern;

wherein the illumination pattern comprises a predetermined timing sequence of LED activation and deactivation that is specific to a type of the event, wherein different types of events generate different predetermined timing sequences that are mapped to different actions automatically performed by the follower train.

2. The End-of-Train device as claimed in claim 1, wherein the at least one sensor is at least one of an accelerometer, a proximity sensor, a camera, a daylight sensor and a pressure sensor.

3. The End-of-Train device as claimed in claim 1, further comprising a radio-frequency transceiver unit configured to generate a radio signal upon failure of the visibility marker.

4. The End-of-train device of claim 1, further comprising:

a transceiver unit configured to enable communication between the End-of-Train device and a Head-of-Train device associated with the train.

5. A system for managing operation of a follower train based on events signaled by a visibility marker on a leading train, the system comprising:

an End-of-Train device mounted on the leading train, the End-of-Train device comprising:

at least one sensor for detecting an event affecting an operation of the leading train;

a visibility marker comprising one or more LEDs; and a control circuitry configured to generate an illumination pattern by selectively activating the one or more LEDs based on the event, wherein the illumination pattern is indicative of an instruction for controlling operation of the follower train;

a secondary sensor installed on the follower train, wherein the secondary sensor is configured to detect the illumination pattern generated by the visibility marker on the leading train; and a sensing subsystem on the follower train comprising a database storing mappings between illumination patterns and instructions for controlling the follower train, the sensing subsystem configured to automatically execute an instruction mapped to the illumination pattern detected by the secondary sensor.

6. The system as claimed in claim 5, wherein the sensing subsystem is associated with a Head-of-Train device associated with the follower train.

7. The system as claimed in claim 5, wherein the sensing subsystem is associated with a driver-machine interface associated with the follower train.

8. A method for managing operation of a follower train based on events signaled by a visibility marker on a leading train, the method comprising:

identifying, by a sensing subsystem on the follower train, an illumination pattern generated by a visibility marker associated with an End-of-Train device on the leading train, wherein a control circuitry housed by the End-of-Train device generates trigger signals for one or more LEDs of the visibility marker based on an event detected by the control circuitry based on digital inputs received by at least one sensor coupled to the control circuitry, wherein the illumination pattern is identified based on output of one or more secondary sensors on the follower train, and wherein the illumination pattern is indicative of an instruction for controlling operation of the follower train, wherein the illumination pattern comprises a predetermined timing sequence of LED activation and deactivation that is specific to a type of the event, wherein different types of events generate different predetermined timing sequences;

determining, based on a database storing mappings between illumination patterns and instructions for controlling the follower train, an instruction mapped to the identified illumination pattern; and automatically executing the instruction for controlling operation of the follower train.

9. The method as claimed in claim 8, wherein the event is associated with braking of the leading train.

10. The method as claimed in claim 8, wherein the event is associated with reverse movement of the leading train.

11. The method as claimed in claim 8, wherein the event is associated with derailment of the leading train.

12. The method as claimed in claim 8, wherein the event is associated with detection of faults, by the at least one sensor, in a railway track whereon the leading train runs.

13. The method as claimed in claim 8, wherein the event is associated with distance between the leading train and the follower train reducing below a predefined safe distance.

14. The method as claimed in claim 8, wherein the one or more instructions are associated with automatically performing an action on the follower train.

15. The method as claimed in claim 8, wherein the one or more instructions are associated with providing alerts to a driver of the follower train.

* * * * *